US005911278A

United States Patent [19]

Reitz

[11] Patent Number: 5,911,278

[45] Date of Patent: Jun. 15, 1999

[54] CALLIOPE OIL PRODUCTION SYSTEM

[76] Inventor: Donald D. Reitz, 8665 Lamar Dr., Arvada, Colo. 80003

[21] Appl. No.: 08/880,011

[22] Filed: Jun. 20, 1997

[51] Int. Cl.[6] ..... E21B 43/12; E21B 43/18

[52] U.S. Cl. ..... 166/372; 166/68; 417/142; 417/144

[58] Field of Search ..... 166/372, 68; 417/142, 417/138, 137, 144, 145, 149

[56] References Cited

U.S. PATENT DOCUMENTS

| | | | |
|---|---|---|---|
| 1,853,269 | 4/1932 | Harris | 417/142 |
| 2,016,433 | 10/1935 | Humason | 103/5 |
| 2,142,773 | 1/1939 | Athey | 103/51 |
| 2,698,581 | 1/1955 | Maier | 103/46 |
| 3,090,316 | 5/1963 | Montgomery | 166/372 |
| 3,884,299 | 5/1975 | McCarter et al. | 166/68 |
| 3,894,583 | 7/1975 | Morgan | 166/68 |
| 3,941,510 | 3/1976 | Morgan | 417/57 |
| 3,991,825 | 11/1976 | Morgan | 166/68 |
| 4,509,599 | 4/1985 | Chenoweth et al. | 166/370 |
| 4,527,633 | 7/1985 | McLaughlin et al. | 166/370 |
| 4,653,989 | 3/1987 | Mason | 417/392 |
| 4,708,595 | 11/1987 | Maloney et al. | 417/109 |
| 4,711,306 | 12/1987 | Bobo | 166/372 |
| 4,741,673 | 5/1988 | Jubb | 417/53 |
| 4,768,595 | 9/1988 | Smith | 166/369 |
| 4,844,156 | 7/1989 | Hesh | 166/263 |
| 4,923,372 | 5/1990 | Ferguson et al. | 417/53 |
| 5,006,046 | 4/1991 | Buckman et al. | 166/372 |
| 5,069,285 | 12/1991 | Nuckols | 166/311 |
| 5,211,242 | 5/1993 | Coleman et al. | 166/372 |
| 5,374,163 | 12/1994 | Jaikaran | 417/172 |
| 5,417,281 | 5/1995 | Wood et al. | 166/68 |
| 5,431,222 | 7/1995 | Bustamante | 166/105 |
| 5,488,993 | 2/1996 | Hershberger | 166/372 |
| 5,522,463 | 6/1996 | Barbee | 166/68 |
| 5,544,706 | 8/1996 | Reed | 166/379 |
| 5,611,397 | 3/1997 | Wood | 166/68 |
| 5,611,671 | 3/1997 | Tripp, Jr. | 417/126 |
| 5,655,605 | 8/1997 | Matthews | 166/372 |
| 5,671,813 | 9/1997 | Lima | 166/372 |

FOREIGN PATENT DOCUMENTS

| | | | |
|---|---|---|---|
| 570697 | 8/1977 | Russian Federation | 166/372 |

OTHER PUBLICATIONS pp. 125–131, *The Technology of Artificial Lift Methods—vol. 2*, by Kermit Brown, (1977).

pp. 63 and 64, "4 New Ways to Reduce Artificial Lift Expense," *World Oil*, by E.E. DeMoss, (1973).

"Down–Hole Chambers Increase Gas–Lift Efficiency," *The Petroleum Engineer*, by H.W. Winkler and George F. Camp, (part 1—Jun., 1956; part 2—Aug. 1956).

pp. 7–001—7–015, Chapter VII, "Chamber Design," CAMCO Gas Lift Manual, H.W. Winkler and S.S. Smith (1962).

SPE 9913, "Lifting of Heavy Oil with Inert–Gas–Operated Chamber Pumps," by John T. Dewan and John Elfarr, (1981).

*JPT*, "A New Look at Predicting Gas–Well Load–Up," by Steve B. Coleman, Hartley B. Clay, David G. McCurdy and H. Lee Norris III, (Mar., 1991).

*JPT*, "Understanding Gas–Well Load–Up Behavior," by Steve B. Coleman, Hartley B. Clay, David G. McCurdy and H. Lee Norris III, (Mar., 1991).

"Liquid Removal from Gas Wells—Gas Lifting with Reservoir Gas" by E.E. DeMoss and P.W. Orris, (Apr. 1968).

*Primary Examiner*—Hoang C. Dang

*Attorney, Agent, or Firm*—Robert G. Crouch; Holland & Hart LLP

[57] ABSTRACT

A novel apparatus and method for producing oil and natural gas from an oil well in the later stages of the well's lifetime. The apparatus includes a one-way valve located at the bottom of the conventional production tubing and a string of macaroni tubing inserted inside of the production tubing. The three chambers defined by the casing, the production tubing, and the macaroni tubing, are connectable to either the suction or discharge manifolds of the apparatus, which are in turn connectable to a compressor. With the valves manipulated in the appropriate fashion by the controller, pressure differentials can be created in the down-hole region of the well to force oil first into the macaroni tubing and then force it up and out of the macaroni tubing and to the sales line. An optional plunger may be used to help reduce paraffin or scale buildup in the macaroni tubing.

29 Claims, 9 Drawing Sheets

CALLIOPE OIL PRODUCTION SYSTEM

The present invention relates generally to the field of pumping methods and apparatus for oil and gas well production and, more particularly, to an improved method and apparatus with a plurality of longitudinally-extending chambers provided in the well which may be placed under a variety of pressure differential conditions to efficiently produce oil and gas from the well.

BACKGROUND OF THE INVENTION

It should go without saying that, once a well is drilled, it is desirable to get a high percentage of the oil and gas (hydrocarbons) out of the well. With this in mind, there can be considered to be several stages in the life of a well. In the best case, there is a first stage where the hydrocarbon-bearing geologic formation into which the well is drilled exhibits such a high fluid pressure (formation pressure) that the oil flows straight up the wellbore propelled by formation pressure and can be produced very economically. Eventually, however, the fluid pressure of the formation decreases to an extent to where it cannot overcome the hydrostatic pressure of the column of oil in the well and, thus, the oil must be pumped out. It should be understood that throughout this document, the term fluid is used to include both liquids and gases such as the combination of water, liquid oil, and natural gases which are typically produced from oil wells.

Pumping is the focus of the second stage in the life of an oil well. The most widely used pumps are rod pumps in which the pump reciprocally pumps the oil out of the well. While rod pumps are the mainstay of the oil industry, they have many drawbacks. First of all, such pumps have limited efficiency since they are pumping only half the time, i.e., when the pump is moving in one direction, since the pump is being refilled when moving in the other direction. In addition, the flow rate from rod pumps is limited by the displacement of the pump and the speed of operation. Also, the natural gas which comes out of solution from the oil during production can create a gas-lock in the pump. Without liquids in the pump at all times, friction between mechanical parts in the pump may cause the pump to fail. At a minimum, to fix a gas lock in the pump, the pump must be stopped and re-spaced. Worse yet, if re-spacing does not solve the problem, a rod job may be required to replace the pump. This involves the employment of a costly workover rig to remove the rods and pump and affect the repair.

Another drawback of rod pumps is that they cannot tolerate contaminant solids such as sand in the produced fluid, because of the close tolerances in the mechanical parts in the pump. As a result, such contaminants may jam the pump, causing the need for a rod job. Another problem with rod pumps is the inherent pounding of the mechanical parts due to the reciprocating action of the pump. This pounding damages the mechanical parts and particularly may cause the rods in the well to fail. Lastly, rod pumps can typically only be used in straight and slightly-deviated holes, as well as holes that are vertical or close thereto. Even in reasonably straight holes, rod wear on the tubing frequently causes tubing leaks that are expensive to repair.

An alternative to the rod pump is a rotary rod pump which addresses some of the problems of the rod pump while leaving other problems unaddressed. The rotary rod pump does tolerate relatively more gas and sand than the rod pump, but still will not tolerate large quantities of either. In addition, the rotary rod pump is more efficient than the rod pump because it is not limited to producing oil during only half of the pump cycle. Similarly to rod pumps, the rotary rod pump cannot be used with highly-deviated or horizontal wells. Another problem shared by rotary rod pumps is the mechanical failure which can occur over time.

Despite these drawbacks, these mechanical pumps are typically used to produce oil from a well until the remaining pressure in the formation is so low as to not be economically viable to continue the pumping. When this occurs, the well is typically capped off and abandoned, this being the third and final stage in the life of the well.

There have been attempts, however, by others to design apparatus that would make it economically viable to continue to pump oil from such wells. This typically includes apparatus which rely on creating pressure differentials in the well in the vicinity of the geologic hydrocarbon-bearing zone and pumping the oil out with a fluid pumped down from the wellhead. Examples of such techniques are disclosed in U.S. Pat. Nos. 3,941,510 (Morgan), 3,991,825 (Morgan), 4,923,372 (Ferguson, et al.), 3,884,299 (McCarter, et al.), 3,894,583 (Morgan), and others. Many of these techniques share common problems. First of all, many of these techniques require a packer to seal off the annular region between the oil well casing and the production tubing. The problems of inserting and maintaining a packer in the oil well include the cost of the packer itself as well as additional rig time to install and remove the device in or from the well. Many of these techniques also include highly-complex apparatus at the bottom of the bore hole which have a variety of labyrinth-like passageways with close tolerances. While such apparatus may perform well in theory, the passageways of such apparatus are very likely to become clogged with contaminants such as the sand, paraffin, scale, and/or grit which are typically produced in such wells. In addition, some of these techniques require a plunger in the production tubing to force the oil up and out therefrom. Also, many of these techniques will not work in deviated holes. Another complicating factor is that many of these techniques have valves that are included in the complex down-hole arrangement. The control of these valves and the replacement thereof is obviously greatly complicated by their presence at the bottom of the hole. Another problem, common to many of these techniques is that the parts used in the apparatus are not rugged, standard oil field parts, but instead are highly-toleranced, sensitive, custom-built parts which may not stand up to the use and abuse which is typical oil field. Also, many of these techniques require a side tubing string outside of and parallel to the production tubing. It is also believed that some of these techniques are limited as to the oil well depth at which they may operate. Lastly, it is not believed that many or any of these techniques are operable to draw a vacuum on the geologic hydrocarbon-bearing zone so as to more completely deplete the zone of hydrocarbons.

It is against this background and the desire to solve the problems of the prior art that the present invention has been developed.

SUMMARY OF THE INVENTION

Accordingly, it is an object of the present invention to provide an oil well producing apparatus which will continue to economically produce oil and/or gas from a well even when the formation pressure is relatively low.

It is also an object of the present invention to provide an oil well producing apparatus which will be economical to produce, operate, and maintain.

It is further an object of the present invention to provide an oil well producing apparatus which will be rugged and relatively immune to contaminants.

It is still further an object of the present invention to provide an oil well producing apparatus which will be relatively more tolerant to a variety of gas to oil ratios.

It is still further an object of the present invention to provide an oil well producing apparatus which will be more energy efficient.

It is still further an object of the present invention to provide an oil well producing apparatus which will minimize the build up of paraffin and other undesirable substances on the oil well tubing.

It is still further an object of the present invention to provide an oil well producing apparatus which will apply a relatively low pressure to the formation so as to further deplete the formation.

It is still further an object of the present invention to provide an oil well producing apparatus which will use conventional oil field equipment.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the present invention is directed to a method of producing hydrocarbons from a well having a wellhead and a well bottom, with an elongated well casing received therein, the well casing having a perforation zone defined therein proximate to the well bottom. The method includes the steps of (a) providing first and second elongated chambers within the casing, each chamber extending from the wellhead to an area proximate to the perforation zone of the well casing; (b) increasing the fluid pressure in the first chamber to force fluids from the first chamber into the second chamber; (c) receiving fluids from the second chamber at the wellhead; and (d) decreasing the fluid pressure in the first and second chambers to draw fluids from the well casing into the first and second chambers.

The method further includes one of the first and second chambers being located within the other of the first and second chambers. Also, the first and second chambers may be concentrically located. The second chamber may be located within the first chamber. The providing step may include providing a third chamber defined between the outer surface of the first chamber and the well casing, wherein the first chamber is in fluid communication with the third chamber via a one-way valve which opens when the fluid pressure in the third chamber is higher than the fluid pressure in the first chamber and closes when the fluid pressure in the third chamber is lower than the fluid pressure in the first chamber. Steps (b), (c), and (d) may be repeated cyclically to produce fluids from the well. The third chamber may be in fluid communication with the wellhead to receive gaseous fluids therefrom.

The present invention is also directed to an artificial lift apparatus for a hydrocarbon producing well having a wellhead and a well casing therein, the wellhead being connected to a sales pipeline for producing hydrocarbons thereto, the well casing having a perforation zone therein to allow hydrocarbons to enter the well from the surrounding subterranean region, the lift apparatus being connectable to a compressor having a suction port and a discharge port. The lift apparatus includes a first elongated tubing extending from the wellhead to a depth in the well in the vicinity of the perforation zone of the well casing, the tubing having a one-way valve near a bottom end thereof to allow hydrocarbons in the well casing to enter the first tubing when the fluid pressure on the well casing side of the one-way valve is greater than the fluid pressure on the first tubing side of the one-way valve, and the tubing having a control valve near an upper end thereof that is selectively coupleable to the suction and discharge ports of the compressor. The apparatus also includes a second elongated tubing extending from the wellhead to a depth in the well in the vicinity of the perforation zone of the well casing, the second tubing being in fluid communication with the first tubing in the vicinity of a bottom end of the second tubing, the second tubing having a control valve near an upper end thereof that is selectively closed or coupleable to the sales pipeline or to the suction port of the compressor. The lift apparatus is operated in cyclic fashion, with a compression stage in which the first tubing is coupled to the discharge port of the compressor while the control valve of the second tubing is closed, a production stage in which the first tubing is coupled to the discharge port of the compressor while the second tubing is coupled to the sales pipeline, and an evacuation stage in which the first and second tubing are each coupled to the suction port of the compressor.

The second tubing may be located within the first tubing. The chamber defined between the well casing and the tubing may be in fluid communication with the sales pipeline. The apparatus may further include a plunger slidably received within the second tubing to decrease the build-up of substances on the inner surface of the second tubing. The upper portions of the second tubing may be heated by the heat in the upper portion of the first tubing resulting from the inherent heat generated by the compression process of the compressor and delivered to the first tubing through the discharge port of the compressor. The apparatus may further include a controller communicating with the control valves of the first and second tubing to control said valves. The controller may transition from the compression stage to the production stage after sensing an increase in fluid pressure in the second tubing past a predetermined threshold. The controller may transition from the production stage to the evacuation stage after sensing a decrease in fluid pressure in the second tubing past a predetermined threshold. The controller may transition from the production stage to the evacuation stage after a predetermined time period elapses from the entry into the production stage. The controller may transition from the evacuation stage to the compression stage after sensing a decrease in fluid pressure in the first or second tubing past a predetermined threshold. The controller may transition from the evacuation stage to the compression stage after a predetermined time period has elapsed from the entry into the evacuation stage.

The second tubing may include a decelerator located therein near the upper end thereof to decelerate the rising plunger, the decelerator including a piston slidably received within the second tubing and constrained for movement in a region near the upper end of the second tubing. The second tubing may include a decelerator located therein near the lower end thereof to decelerate the falling plunger, the decelerator including a spring. The second tubing may include a plunger catcher to prevent the plunger from falling back down the second tubing until such time as it is desired for the plunger to fall. The plunger catcher may be pneumatically operated and include a finger that can be forced to protrude into the second tubing. The hydrocarbons may be produced at a sufficiently high pressure to supply to a high pressure sales pipeline. The second tubing may be equal to or less than 1.75 inches in diameter.

The present invention is also directed to an artificial lift apparatus for a hydrocarbon producing well having a wellhead and a well casing therein, the wellhead being connected to a sales pipeline for producing hydrocarbons thereto, the well casing having a perforation zone therein to allow hydrocarbons to enter the well from the surrounding subterranean region, the lift apparatus being connectable to a compressor having a suction port and a discharge port. The lift apparatus includes a first elongated tubing extending from the wellhead to a depth in the well in the vicinity of the perforation zone of the well casing, the tubing having a one-way valve near a bottom end thereof to allow hydrocarbons in the well casing to enter the first tubing when the fluid pressure on the well casing side of the one-way valve is greater than the fluid pressure on the first tubing side of the one-way valve, and the tubing having a control valve near an upper end thereof that is selectively closed or coupleable to the sales pipeline or coupleable to the suction port of the compressor. The apparatus also includes a second elongated tubing extending from the wellhead to a depth in the well in the vicinity of the perforation zone of the well casing, the second tubing being in fluid communication with the first tubing in the vicinity of a bottom end of the second tubing, the second tubing having a control valve near an upper end thereof that is selectively coupleable to the suction and discharge ports of the compressor. The lift apparatus is operated in cyclic fashion, with a compression stage in which the second tubing is coupled to the discharge port of the compressor while the control valve of the first tubing is closed, a production stage in which the second tubing is coupled to the discharge port of the compressor while the first tubing is coupled to the sales pipeline, and an evacuation stage in which the first and second tubing are each coupled to the suction port of the compressor.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 3:
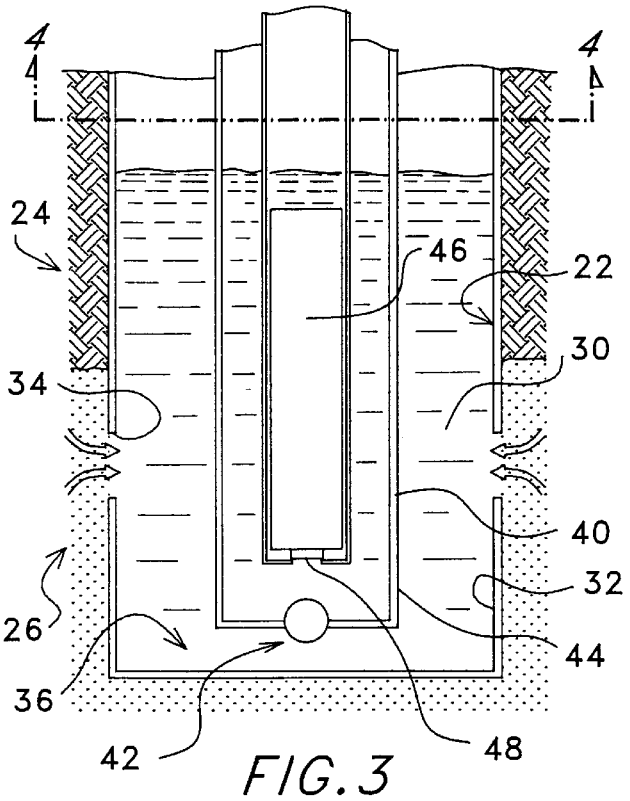
FIG. 3 is a cross-sectional view of the bottom end of a well with macaroni tubing of the present invention inserted into production tubing and the fluid levels showing the situation when the apparatus of the present invention is not operating.

The system 20 of the present invention (FIGS. 1 and 3) is intended to operate in the environment of a hydrocarbon (oil and gas) well. As shown in FIG. 3, the well typically includes a deep bore hole 22 drilled into the earth 24 and extending into a subterranean zone 26 which contains oil 30 and gas. The bore hole 22 is typically fitted with a well casing 32 which is slidably received and cemented therein and preserves the integrity of the bore hole 22. The casing 32 typically has a plurality of perforations 34 therethrough which places the interior of the well casing 32 in fluid communication with the hydrocarbon-bearing zone 26 to allow oil 30 to enter the casing 28. The depth of the well is typically in the range of 4,500 to 9,500 feet deep, depending on the geographic area and the location of the hydrocarbon-bearing zone 26 under the ground. The location of the perforations 34 may be up to 60 or 70 feet above the bottom of the well, with the area beneath the perforations known as the catch basin 36 or rat hole. The diameter of the well casing 32 may typically be 5½ or 4½ inches. Into the well casing 32, a string of production tubing 40 is inserted. The production tubing is typically 2⅞ or 2⅜ inches in diameter. The production tubing 40 is typically extended into the well deep enough to be at or below the perforations 34 and extend into the catch basin 36. Up to this point, this description of the down-hole portion of an oil well is common to other known oil well production systems.

The present invention adds to this technology by providing a one-way valve 42 (such as a Harbison-Fisher 133-H-2) at the bottom of the production tubing 40, as shown in FIG. 3. This one-way or standing valve 42 allows fluid to pass from outside of the production tubing 40 into the production tubing 40 when the pressure outside of the tubing 40 is greater than or equal to the pressure inside of the tubing 40. When, however, the pressure inside of the tubing 40 is greater than the pressure outside of the tubing 40, the valve 42 will close and no oil will flow therethrough. In actuality, the standing valve 42 may include a pair of standing valves in tandem for redundancy. Since the macaroni tubing described below must be removed from the production tubing 40 in order to remove the standing valve 42, it is desirable to reduce the frequency of such repairs by having this redundancy.

Figure 4:
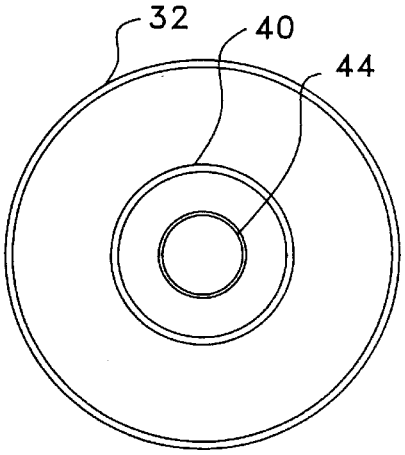
FIG. 4 is a cross-sectional view taken along the line 4—4 of FIG. 3.

In addition, the present invention provides another string of tubing know as macaroni tubing 44 (FIGS. 3 and 4) inside of the production tubing 40 and ending near (e.g., five feet above) the bottom of the production tubing 40. The macaroni tubing 44 may typically have a diameter of between 1 and 1¾ inches. The macaroni tubing 44 includes a plunger 46 slidably received therein which will be described in more detail below. The macaroni tubing 44 also includes a plunger spring 48 located at a bottom end thereof to assist in decelerating the plunger 46 when it falls back down the macaroni tubing 44. The macaroni tubing 44 is at least partially open at the bottom end thereof so that the inside of the macaroni tubing 44 is in fluid communication with the region outside of the macaroni tubing 44 which is located in the production tubing 40. Alternatively, the macaroni tubing 44 could be coil tubing. Throughout the remainder of this description, the annular region between the macaroni tubing 44 and the production tubing 40 will be concisely referred to as the production tubing while the annular region between the well casing 32 and the production tubing 40 will be concisely referred to as the well casing 32.

With this arrangement located down-hole in the bore hole 22 shown in FIG. 3, it can be appreciated that the fluid pressure in the hydrocarbon-bearing zone 26 will cause oil 30 to enter the well casing 32 to an extent to where the hydrostatic pressure of the oil 30 within the casing 32 above the perforations 34 offsets the pressure of the zone 26 at the perforations 34. In addition, these equally and offsetting pressures in the oil 30 will cause the one-way valve 42 to open and allow the oil 30 to enter the production tubing 40 and the macaroni tubing 44 until the oil level is approximately equivalent in each of the three chambers defined by the casing 32, production tubing 40, and the macaroni tubing 44. It can be appreciated that the plunger 46 is sufficiently smaller in diameter than the macaroni tubing 44, so that the oil 30 can pass thereby.

Figure 1:
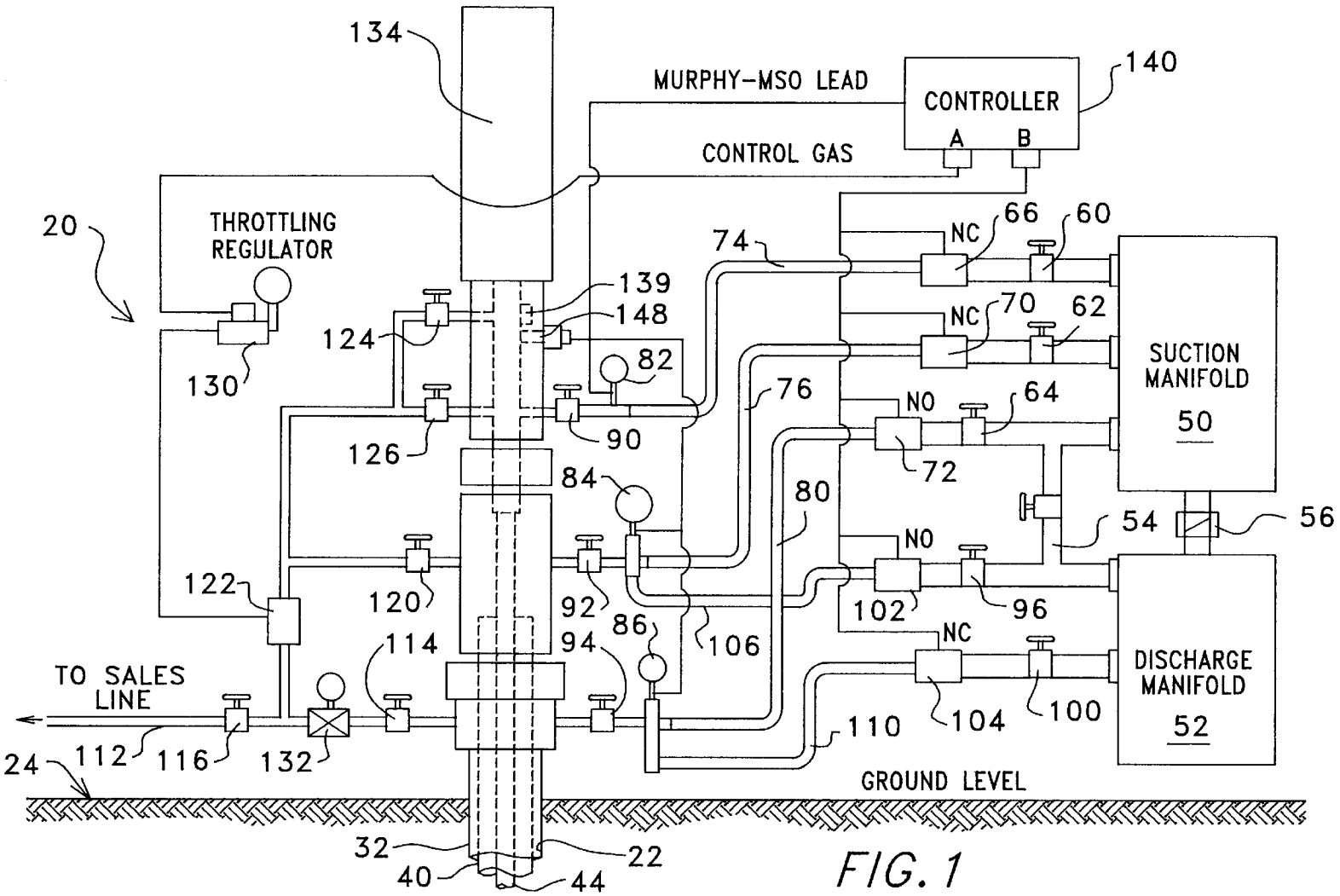
FIG. 1 is a schematic of the fluid and mechanical connections of the apparatus and method of the present invention at a wellhead.

The system 20 of the present invention also includes apparatus at the top or wellhead of the well, as seen best in FIG. 1. This apparatus is intended for connection to a compressor (not shown). The compressor is used to create a pressure differential between the various chambers in the bore hole 22 so as to produce oil and gas therefrom. While not a part of this invention, the compressor can be connected to a suction manifold 50 and a discharge manifold 52 of the system 20. The compressor connected to the apparatus of the present invention may be any commercially available compressor such as Model JGI from Ariel Corp. of Mt. Vernon, Ohio, or any other suitable compressor. Preferably, the compressor should be capable of delivering 50 to 200 thousand cubic feet per day with suction pressures ranging from −10 inches of mercury (in. Hg) to 65 pounds per square inch (PSI) and discharge pressures up to 1500 PSI.

The connections between the various components at the wellhead typically include conventional high-pressure fluid lines such as standard oil field plumbing, or hoses such as high-pressure steel braided hoses with 1000 to 1500 PSI working pressure as are available from Advanced Metal Hose of Denver, Colo., as shown in FIG. 1. These may be one or two inch lines or hoses. The suction manifold 50 and the discharge manifold 52 are connected together by a start-up by-pass 54 and a swing check valve 56. The start-up bypass 54 is operational to allow direct drive compressors to be started without a load on the compressor. The swing check valve 56 is a one-way valve that opens when the pressure in the suction manifold 50 exceeds the pressure in the discharge manifold 52. This pressure differential in this "reverse" direction may occur during the transition between the various stages of the hydrocarbon-production cycle as described in more detail below.

The suction manifold 50 is connected to the macaroni tubing 44, the production tubing 40, and the casing 32 through manual valves 60, 62, and 64, respectively, motor valves 66, 70, and 72, respectively, flexible hoses 74, 76, and 80, respectively, pressure sensors 82, 84, and 86, respectively, and manual valves 90, 92, and 94, respectively, as shown in FIG. 1. As can be seen, the suction manifold 50 is thus connected to the macaroni tubing 44 through the manual valve 60, the motor valve 66, the flexible hose 74, the pressure sensor 82, and the manual valve 90. Likewise, the suction manifold 50 is connected to the production tubing 40 through the manual valve 62, the motor valve 70, the flexible hose 76, the pressure sensor 84, and the manual valve 92. Similarly, the suction manifold 50 is connected to the casing 32 through the manual valve 64, the motor valve 72, the flexible hose 80, the pressure sensor 86, and the manual valve 94. The motor valves 66 and 70 are normally-closed valves which only open when they receive an input signal, while the motor valve 72 is a normally-open valve which only closes when it receives an input signal. The pressure sensors may be Murphy switches, such as an OPL FC-A-1000 from Murphy Controls of Tulsa, Okla.

The discharge manifold 52 is connected to the production tubing 40 and the casing 32 through manual valves 96 and 100, respectively, motor valves 102 and 104, respectively, flexible hoses 106 and 110, respectively, pressure sensor 84 and 86, respectively, and manual valves 92 and 94, respectively, as shown in FIG. 1. Thus, the discharge manifold 52 is connected to the production tubing 40 through manual valve 96, motor valve 102, flexible hose 106, pressure sensor 84, and manual valve 92. Similarly, the discharge manifold 52 is connected to the casing 32 through manual valve 100, motor valve 104, flexible hose 110, pressure sensor 86, and manual valve 94. The motor valve 102 is a normally-open valve and is closed only when it receives an input signal, while the motor valve 104 is a normally-closed valve and only opens when it receives an input signal. All of the motor valves 66, 70, 72, 102, and 104 may be one or two inch Kimray motor valves (1400 SMT or 2200 SMT), or any suitable equivalent valve.

Each of the casing 32, the production tubing 40, and the macaroni tubing 44 are connectable to a sales line (not shown) through an output line 112, as shown in FIG. 1. The casing 32 is connectable to the sales line through a manual valve 114, a manual valve 116, and the output line 112. The production tubing 40 is connected to the sales line through a manual valve 120, a main motor valve 122, the manual valve 116, and the output line 112. The macaroni tubing 44 is connected to the sales line through a pair of manual valves 124 and 126, the main motor valve 122, the manual valve 116, and the output line 112. The main motor valve 122 may optionally be controlled by a throttling regulator 130. The casing 32 is also connected to the sales line through a back pressure valve 132 connected between the casing 32 and the output line 112. The back pressure valve 132 only opens when the pressure in the casing 32 exceeds the greater of the pressure in the output line 112 or a preset back pressure of between 50 PSI and 100 PSI, depending on the individual characteristics of each well. Thus, for relatively high-pressure sales lines which may be experienced in some geographic areas, there will be no effect on the pressure in the casing 32. The main motor valve 122 may be a two inch Kimray motor valve (2200 SMT), while the throttling regulator 130 may be a Kimray HPG-30. The optional throttling regulator 130 may be used to modulate the opening of the main motor valve 122 to attempt to decelerate the plunger 46.

Figure 12:
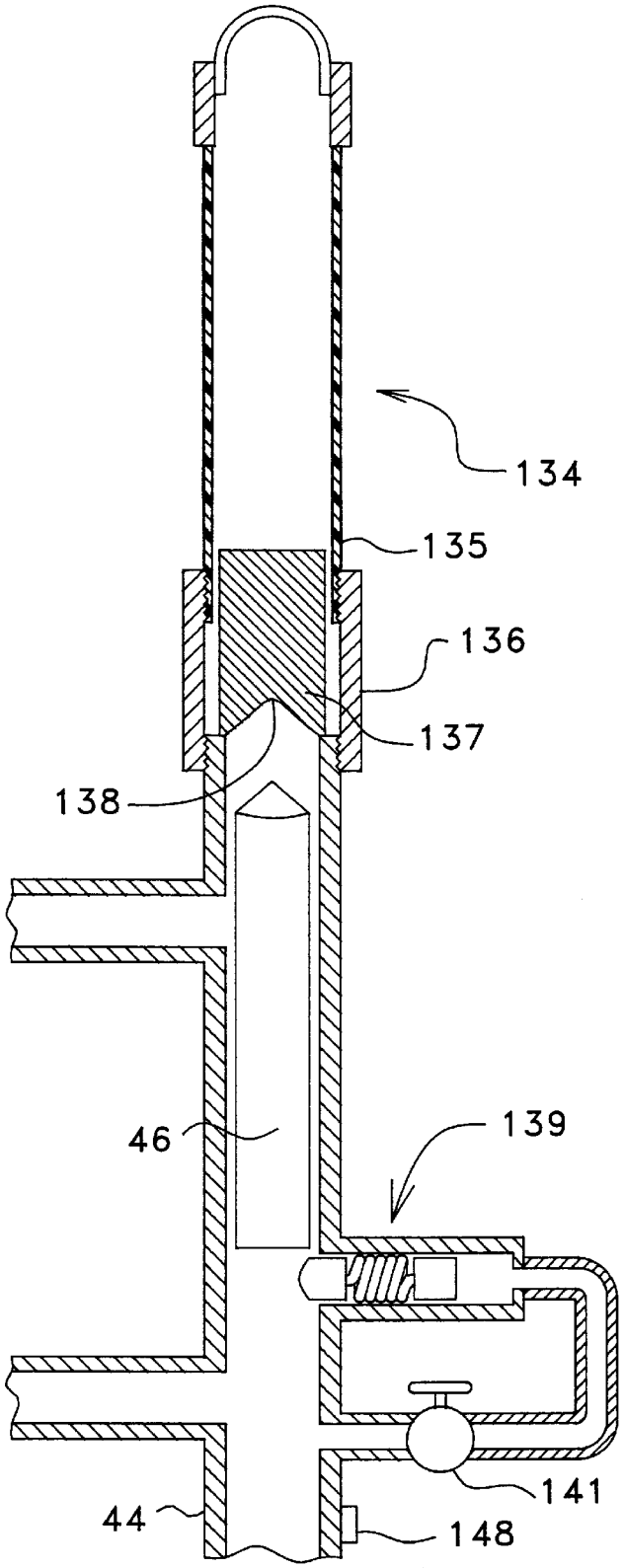
FIG. 12 is a side and partial sectional view of a decelerator and plunger catcher located at the top of the wellhead of FIG. 1, to decelerate and catch the plunger at the end of the production stage.

The apparatus at the wellhead of the present invention also includes a decelerator 134 located at the top of and in communication with the macaroni tubing 44, as shown in FIGS. 1 and 12. The decelerator 134 is functional to decelerate the plunger 46 as it comes up the macaroni tubing 44 with significant velocity as is described in more detail in the operational section below. The decelerator 134 is preferably composed of a length of two-inch-diameter fiberglass tubing 135 attached to the macaroni tubing 44 by a collar 136 and includes a piston 137 slidably received within the decelerator 134. The piston 137 features a conical indentation 138 defined on a bottom side thereof. When struck by the plunger 46, the piston 137 moves upward into the decelerator 134, compressing the gas thereabove. The force exerted by the compressed gas acts against the piston 137 to decelerate the plunger 46.

Also associated with the macaroni tubing 44 and located just beneath the decelerator 134 is a pneumatic plunger catcher 139 (FIG. 12) which operates to catch the plunger 46 after it has been decelerated and before it can fall back down the macaroni tubing 44. The plunger catcher 136 is available as Model No. LB-A001 from Production Control Services, Inc. of Ft. Lupton, Colo. The plunger catcher 139 is pressurized from behind by pressures greater than 15 PSI in the macaroni tubing 44 so that the end of the plunger catcher 139 yieldingly protrudes into the macaroni tubing 44. The design of the plunger catcher 139 allows the catcher 139 to yield and allow the plunger 46 to pass thereby when the plunger 46 is moving up the tubing 44, but will not allow the plunger 46 to pass thereby (so as to catch the plunger 46) when the plunger is moving down the tubing 44. When the pressure in the tubing drops below 15 PSI, the catcher 139 pulls back to not protrude into the tubing 44 and allow the plunger to drop down the tubing 44 to the bottom of the bore hole. Should it be desired to retain the plunger 46 above the catcher 139 even after the pressure drops, a valve 141 can be manually closed to keep the catcher 139 pressurized. The reason two valves 124 and 126 connect the macaroni tubing 44 to the output line 112 is because the plunger 46 will tend to be suspended or levitated in the area of the uppermost outlet from the macaroni tubing 44 in the latter stages of the production stage while the oil 30 and gas are being produced to the sales line if there were not a plunger catcher 139. In systems which include a plunger catcher 139, it may be possible to eliminate one of the valves 124 and 126.

Figure 2:
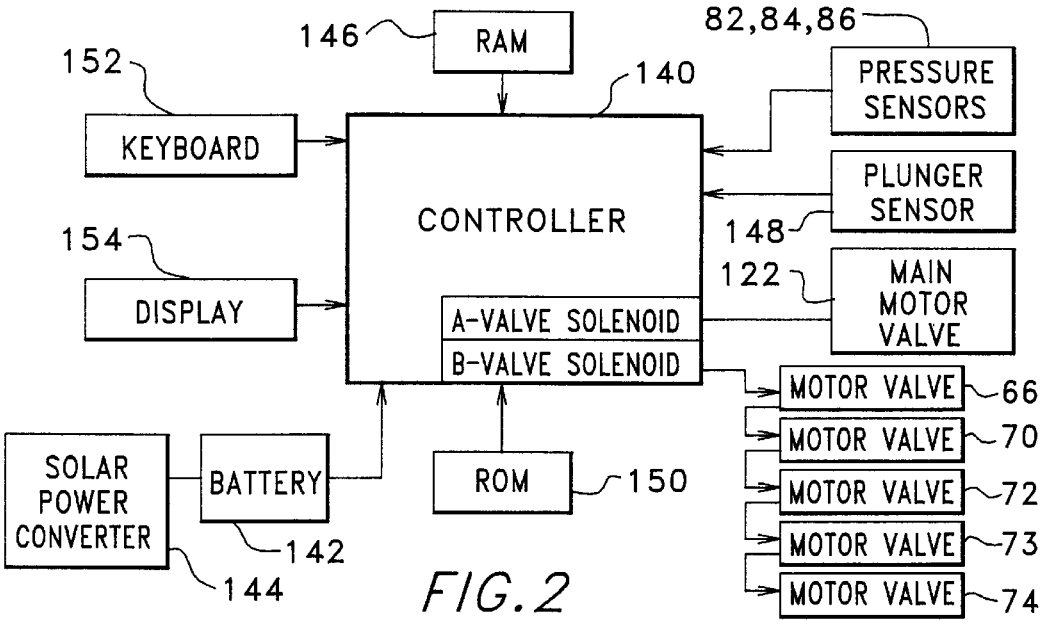
FIG. 2 is a block diagram of the electronic and electromechanical components of the system of the present invention shown in FIG. 1.

A microprocessor-based controller 140, as shown in FIGS. 1 and 2, is provided to sense the position of the plunger 46 as well as the pressure sensed by the pressure sensors 82, 84, and 86, and to control the operation of the motor valves 66, 70, 72, 102, 104, and the main motor valve 122.

The controller 140 (such as a PCS 2000®), shown in block diagram format in FIG. 2, is powered by a battery 142 connected to a source for generating electricity from solar power; or solar power converter 144. The logic has been modified to implement the logic described in the operational section below, or any other suitable logic. The microprocessor may be a Signetics 87C51 or Atmel 89C51, or any other suitable microprocessor. The controller 140 is connected to RAM memory 146 and ROM memory 150. The controller 140 can be accessed by an operator through a keyboard 152 and a display 154. The controller 140 receives inputs from each of the pressure sensors 82, 84, and 86. The controller 140 also receives an input from the plunger sensor 148 indicating when the plunger 46 has arrived and has been caught. The controller 140 is provided with a program (described in more detail below) which is performed by the controller 140 to process these inputs and determine and control the stage of the oil production cycle for the system 20. The controller 140 then controls the main motor valve 122 and the other five motor valves, 66, 70, 72, 102, and 104 to place the system 20 in each of the desired stages. As can be appreciated, the main motor valve 122 can be opened or closed through operation of the A-valve solenoid in the controller 140 to provide control gas so as to open or close the main motor valve 122. The controller 140 can also control the five motor or B-valves 66, 70, 72, 102, and 104 through the B-valve solenoid in the controller 140 to change their state. As described before, each of the five B-valves 66, 70, 72, 102, and 104 has a normal operational state which each of the valves is in when no input signal is provided. When the controller 140 desires to change the state of these valves, it provides a single input signal which is routed to each of the five B-valves 66, 70, 72, 102, and 104 to change their state.

Figure 11:
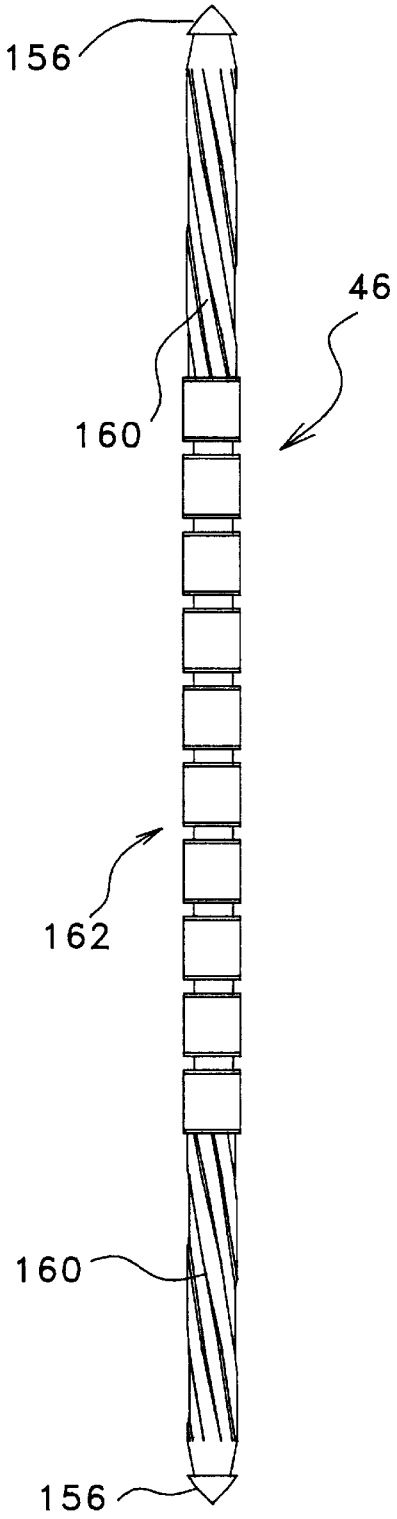
FIG. 11 is a close-up side view of the plunger shown in FIG. 3.

The plunger 46, as shown in FIG. 11, is an elongated plunger 46 having a largest outer diameter of from 0.94 to 1.25 inches. The 0.94 inch size corresponds to the 1 inch macaroni tubing 44 described above. The macaroni tubing 44 may be toleranced so as to allow a minimum inner diameter of 0.955 inches so that at least 0.015 inches of total spacing is provided between the plunger 46 and the macaroni tubing 44. As can be appreciated, the plunger 46 has a head 156 at either end of thereof. Proximate to each of the heads 156 is a region 160 of grooves spiraling along the length of the plunger 46. In the central portion 162 of the plunger 46 are alternating cylindrical surfaces of maximum diameter and a reduced diameter. Plungers of various lengths, diameters, and shapes may be used depending on the character of each well and other factors. It should be emphasized that the use of the plunger 46 in the system 20 of the present invention is entirely optional. More specifically, it has been discovered that because of the relatively small diameter of the macaroni tubing 44 and the natural viscosity of the oil 30, the oil 30 can be lifted out through the macaroni tubing 44 by fluid pressure without the need for the plunger 46. The primary reason to use the plunger 46 is to ream out or clean the macaroni tubing 44 during each cycle, as the macaroni tubing 44 might otherwise tend to become coated and partially clogged with paraffin and other similar substances which are inherent in the oil production cycle. The removal of paraffin is made easier by the temperature of the gas in the upper part of the production tubing 40 being at a relatively high temperature (e.g., 240° F.) as a result of the heat inherently generated in the compression process. The elevated temperature of the gas in the upper part of the production tubing 40 helps to soften or melt the paraffin collecting on the inner surface of the macaroni tubing 44 located in the production tubing 40.

As will be better understood after discussion of each of the stages in the oil production cycle below, the cycle includes a compression stage, a production and after-flow stage and an evacuation stage. The controller 140 controls the various valves described above to place the system 20 into one of each of these stages. The cycle is continuously repeated so that the compression stage of one cycle is followed by the production stage and then the evacuation stage, which is followed by the compression stage of the next cycle, and so on.

Figure 5:
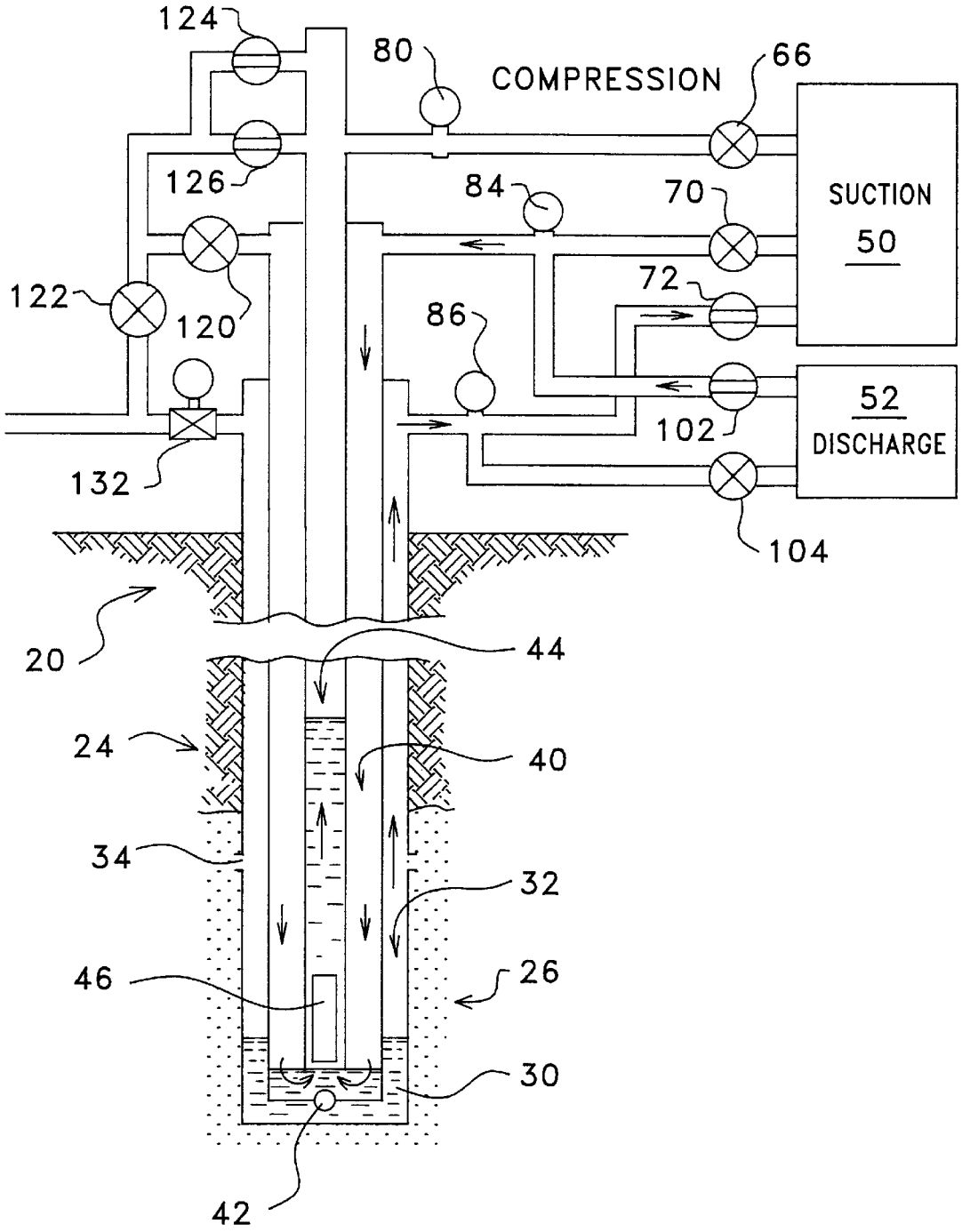
FIG. 5 is a simplified schematic view of the wellhead and the down-hole region of the well demonstrating the compression stage of the hydrocarbon-producing cycle of the present invention.

In the compression stage, shown in FIG. 5, the main motor valve 122 is closed and the five B-valves are in their normal position. Thus, only motor valves 72 and 102 are open, which places the casing 32 in fluid communication with the suction manifold 50 while placing the production tubing 40 in fluid communication with the discharge manifold 52. All valves to the macaroni tubing 44 are closed. Thus, the lower pressure in the casing 32 draws additional oil 30 from the zone 26 into the casing 32. The discharge from the compressor will pressurize the production tubing 40 which pushes all of the oil 30 therein into the macaroni tubing 44 and past the plunger 46. This stage continues until the fluid pressure in the macaroni tubing 44 increases to the point to where the controller 140, via the pressure sensor 80, senses that the pressure has exceeded a predetermined threshold. For example, this pressure threshold may be 125 PSI (after starting at −10 in. Hg). In addition, the pressure in the casing may change from 90 PSI to 50 PSI, while the pressure in the production tubing 40 may change from −10 in. Hg to 780 PSI.

Figure 6:
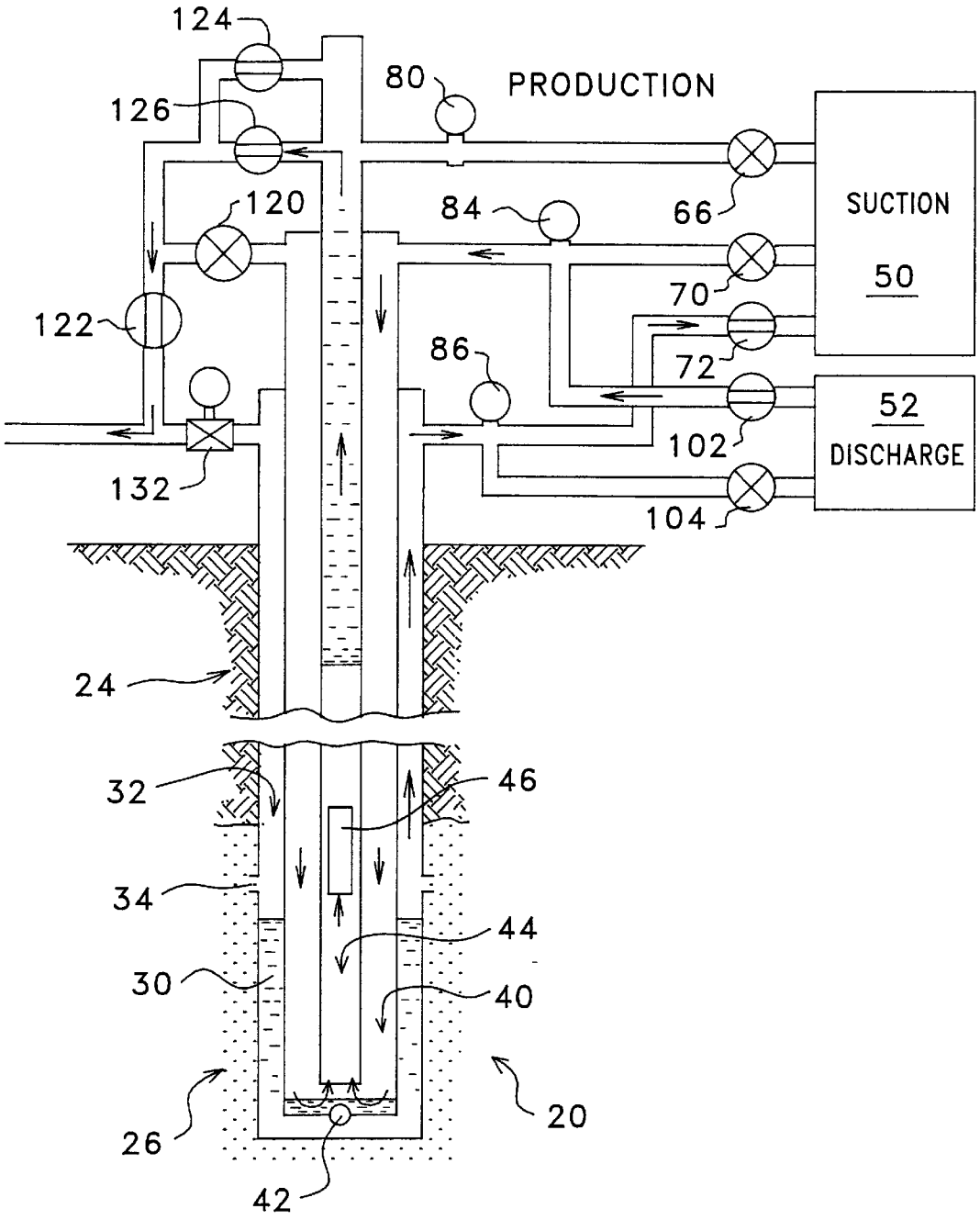
FIG. 6 is a simplified schematic view of the wellhead and the down-hole region of the well demonstrating the production stage of the hydrocarbon-producing cycle of the present invention.
Figure 7:
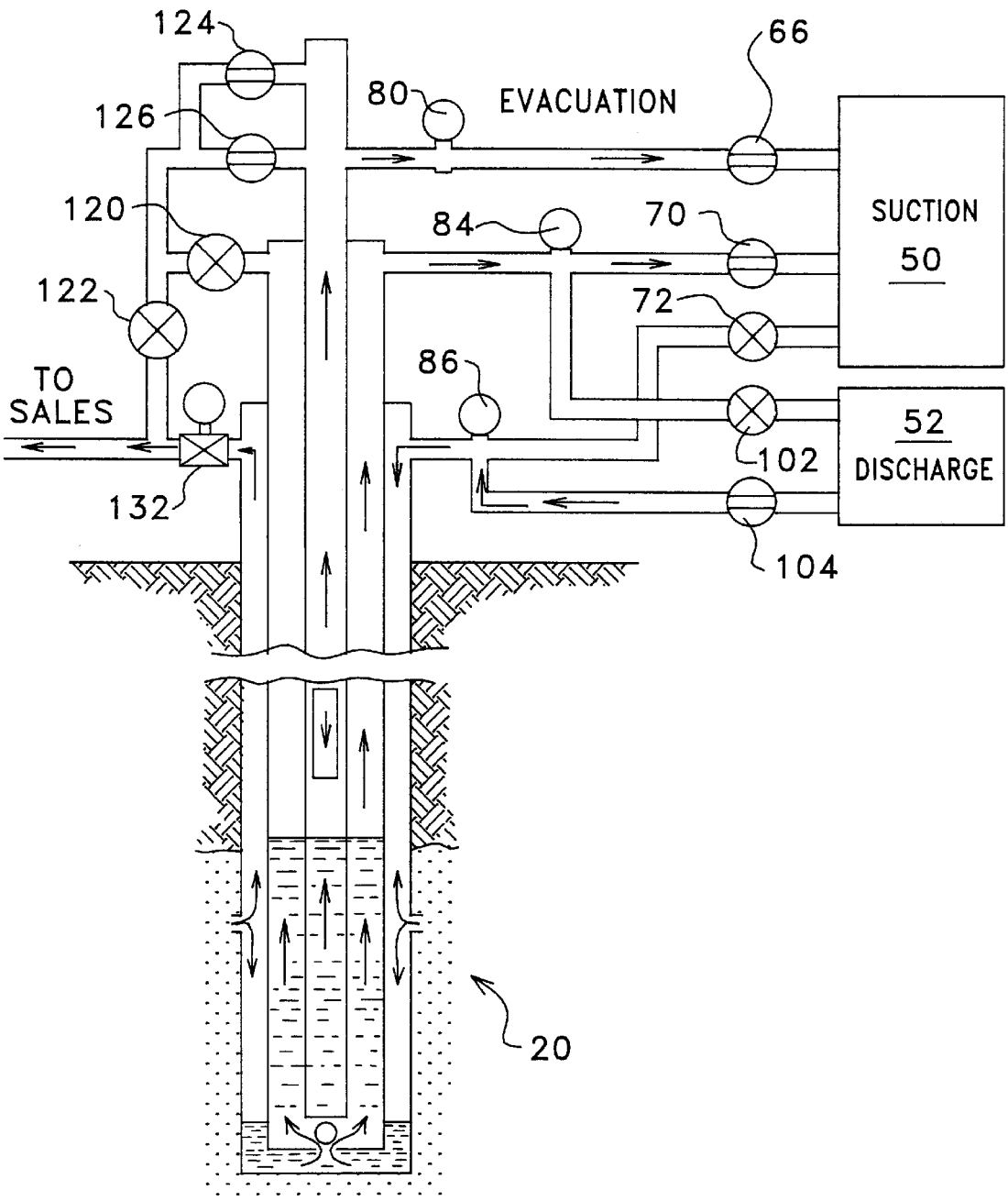
FIG. 7 is a simplified schematic view of the wellhead and the down-hole region of the well demonstrating the evacuation stage of the hydrocarbon-producing cycle of the present invention.

When this threshold is met or exceeded, the controller 140 transitions the system 20 from the compression stage to the production stage by opening the main motor valve 122, as shown in FIG. 6. With the main motor valve 122 open, the macaroni tubing 44 is placed in fluid communication with the sales line and the oil 30 and plunger 46 are moved up the macaroni tubing 44 by the increased and continued fluid pressure in the production tubing 40 caused by the discharge from the compressor. The controller 140 can either be programmed to transition from the production stage to the evacuation stage after a predetermined time period has elapsed (e.g., eighty-five minutes), after the pressure in the macaroni tubing 44 drops to 30 psi, or a given time after the plunger sensor 148 indicates to the controller 140 that the plunger 46 has been caught, meaning that the plunger 46 has traveled up the entire macaroni tubing 44. Alternatively, the controller 140 could be programmed to transition upon the first occurrence of any (or any combination) of those three conditions. In addition, the casing pressure may drop to 40 PSI, while the production tubing may drop to 120 PSI.

After the triggering event occurs, the controller 140 transitions the system 20 from the production stage to the evacuation stage (FIG. 8) by closing the main motor valve 122 and by operating the B-valve solenoid to send control gas to each of the B-valves 66, 70, 72, 102, and 104. Accordingly, the motor valves 66, 70, and 104 are now opened, with motor valves 72 and 102 closed. Thus, suction is applied to each of the macaroni tubing 44 and the production tubing 40, while discharge is applied to the casing 32. Most of the oil 30 in the casing 32 will be forced past the one-way valve 42 and into the production tubing 40 and macaroni tubing 44. During this stage, pressure in both the production tubing 40 and the macaroni tubing 44 falls from 120 PSI and 30 PSI, respectively, to −10 in. Hg. The plunger catcher 139 releases the plunger 46 when pressure in the macaroni tubing 44 falls into the range of 12 to 15 PSI so that the plunger 46 may fall back down the macaroni tubing 44 and be decelerated by the oil 30 and the plunger spring 48.

Once the controller 140 senses a pressure of −10 in. Hg in the production tubing 40, or once a predetermined time period has elapsed (e.g., ninety minutes), the controller 140 transitions from the evacuation stage to the compression stage. The length of the entire cycle, from the beginning of one compression stage to the beginning of the next compression stage, may take in the range of six to eight hours.

On the transition from the production stage to the evacuation stage and also on the transition from the evacuation stage to the compression stage, it may momentarily occur that the pressure seen by the suction manifold 50 from the system 20 exceeds that of the pressure seen by the discharge manifold 52 from the system 20. In this situation, the swing check valve 56 will open to equalize the pressure so that the stage can continue operating as normal after pressure is equalized. Further, the controller 140 may be programmed to open the main motor valve 122 if it senses a pressure of greater than 900 psi in the production tubing and the compressor may shut down if it senses a pressure of 950 psi or greater. Different compressors may have different shutdown thresholds.

As can be appreciated, one added benefit of supplying compressor suction to the casing during the compression and production stages is that this low pressure applied to the hydrocarbon-producing zone 26 via the perforations 34 serves to draw additional oil out of the zone 26 than might otherwise occur. In addition, natural gas is drawn out of the zone 26 and routed through the compressor and out through the discharge manifold 52 and into the production tubing 40 which eventually is sent to the sales line through the macaroni tubing 44. In this manner, natural gas as well as oil 30 is produced from the well. In addition, the system 20 can volunteer natural gas to the sales line anytime casing pressure exceeds the preset pressure on the back pressure valve 132 and pressure in the sales line.

Figure 8:
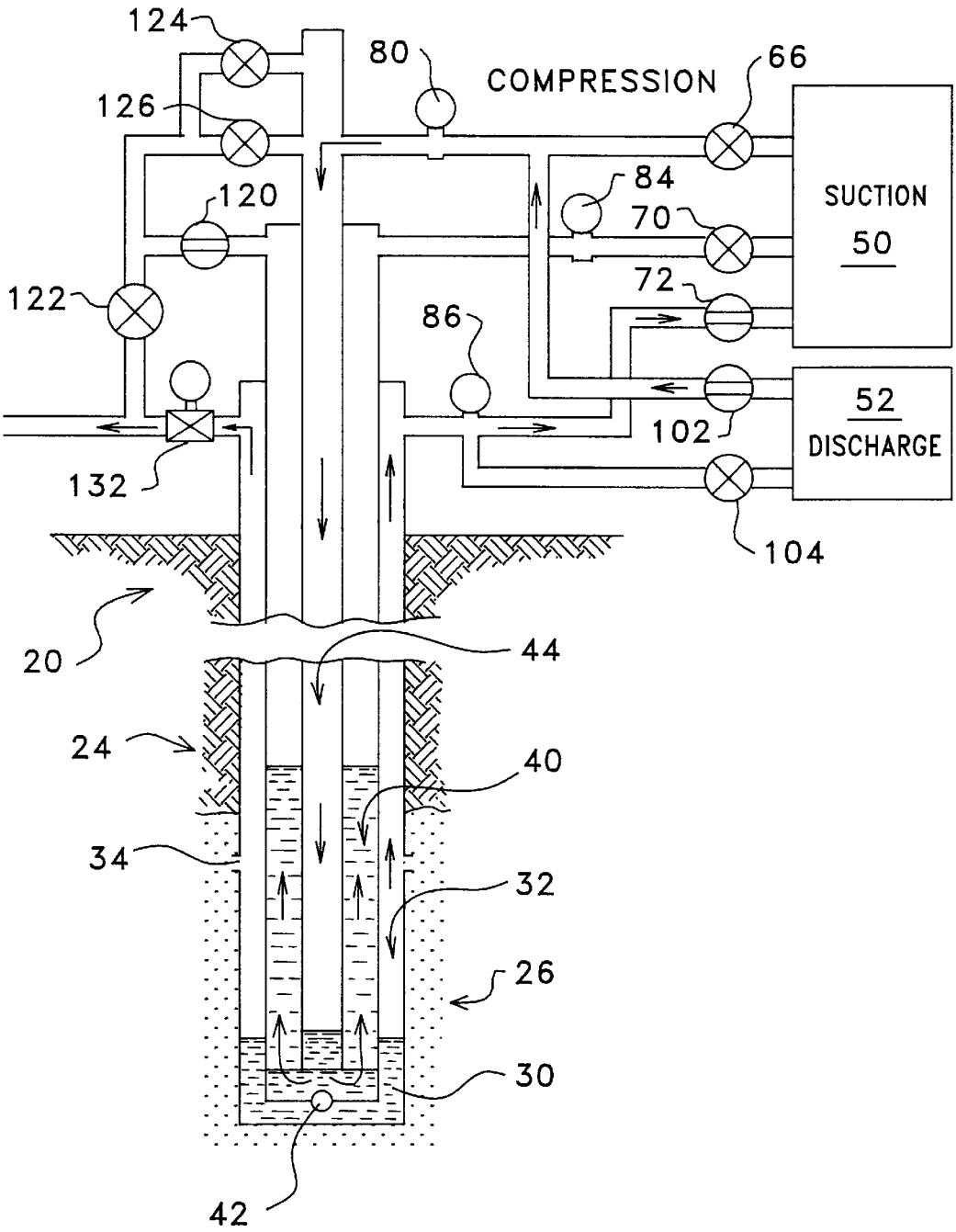
FIG. 8 is a simplified schematic view of the wellhead and the down-hole region of the well with the hydrocarbon-producing cycle being run in reverse in an alternative embodiment to produce oil out of the annular region between the macaroni tubing and regular tubing and demonstrating the compression stage of the hydrocarbon-producing cycle of the present invention.
Figure 9:
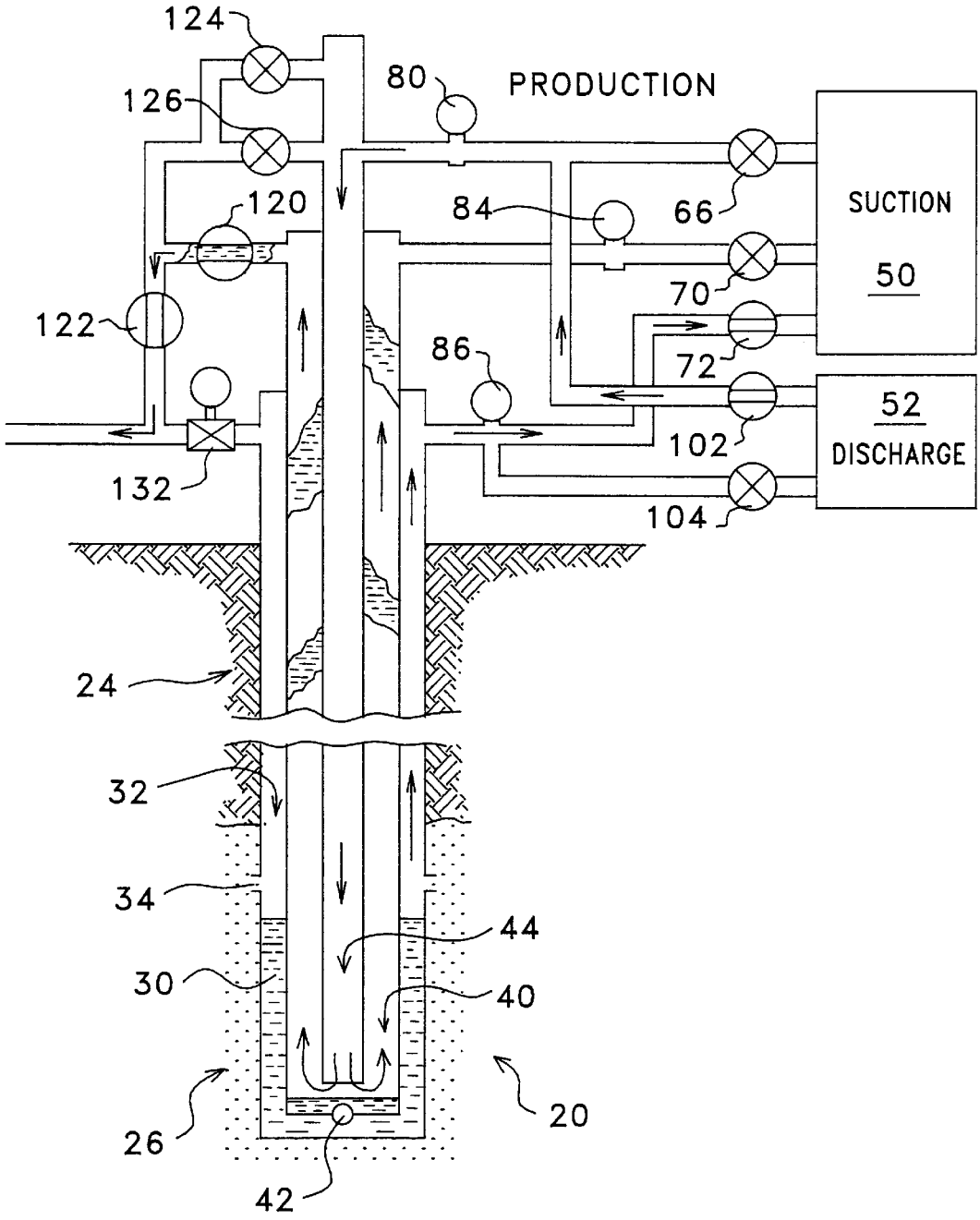
FIG. 9 is a simplified schematic view of the wellhead and the down-hole region of the well with the hydrocarbon-producing cycle being run in reverse in an alternative embodiment to produce oil out of the annular region between the macaroni tubing and regular tubing and demonstrating the production stage of the hydrocarbon-producing cycle of the present invention.
Figure 10:
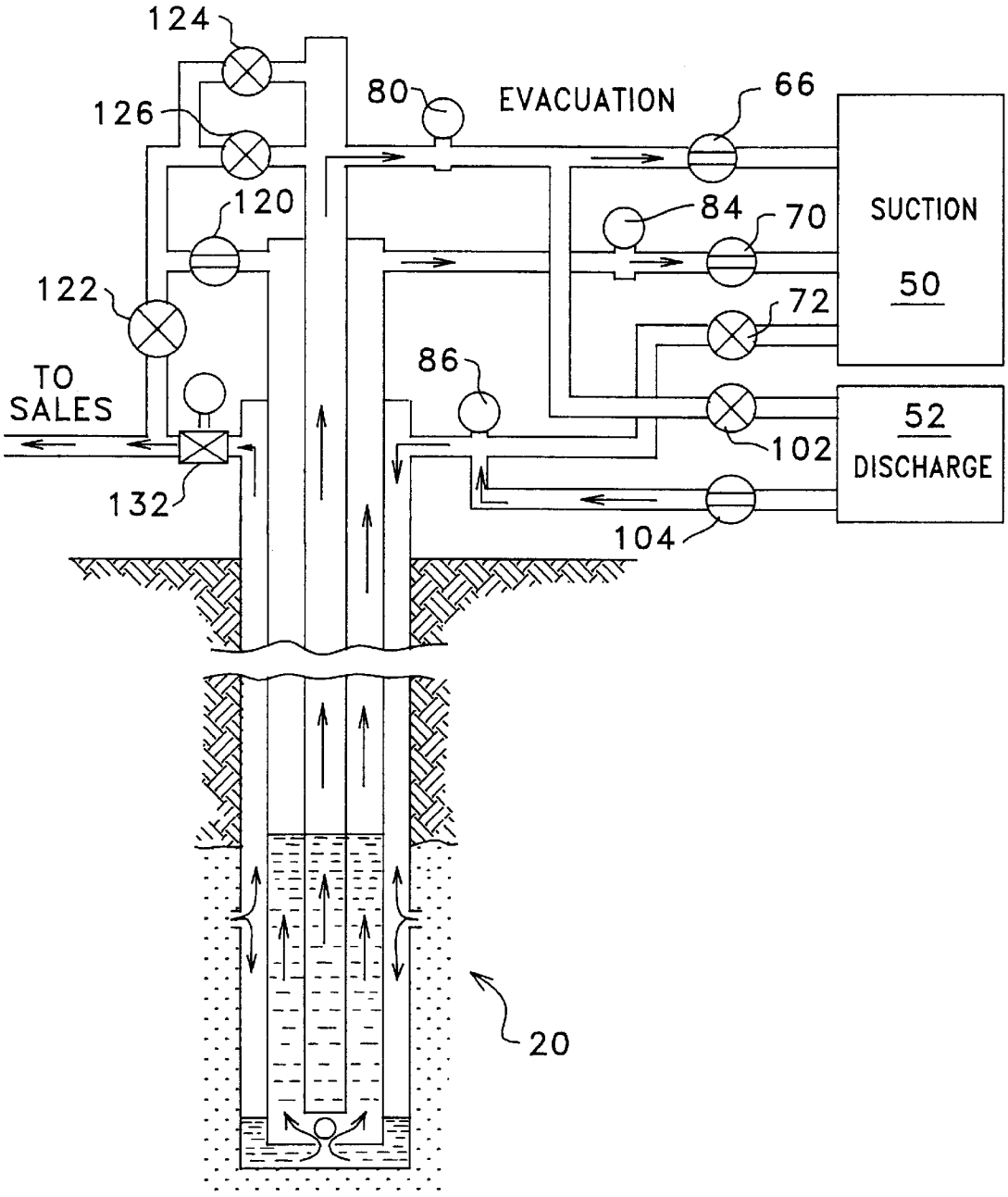
FIG. 10 is a simplified schematic view of the wellhead and the down-hole region of the well with the hydrocarbon-producing cycle being run in reverse in an alternative embodiment to produce oil out of the annular region between the macaroni tubing and regular tubing and demonstrating the evacuation stage of the hydrocarbon-producing cycle of the present invention.

Alternatively, the process can be run in reverse. As shown in FIGS. 8–10, this reverse operation is similar to the normal operation in that the cycle includes a compression stage, a production and after-flow stage and an evacuation stage. However, the valve 120 is opened, exposing the production tubing 40 to the main motor valve 122, and valves 124 and 126 are closed. In addition, the connection of the discharge port 52 to the production tubing 40 through the B-valve 102 is changed to a connection of the discharge port 52 to the macaroni tubing 44 through the B-valve 102. Further, there is no plunger 46 used with the reverse operation. The controller 140 controls the various valves to place the system 20 into one of each of the above-mentioned stages. The cycle is continuously repeated so that the compression stage of one cycle is followed by the production stage and then the evacuation stage, which is followed by the compression stage of the next cycle, and so on.

In the compression stage, shown in FIG. 8, the main motor valve 122 is closed and the five B-valves are in their normal position. Thus, only motor valves 72 and 102 are open, which places the casing 32 in fluid communication with the suction manifold 50 while placing the macaroni tubing 44 in fluid communication with the discharge manifold 52. All valves to the production tubing 40 are closed. Thus, the lower pressure in the casing 32 draws additional oil 30 from the zone 26 into the casing 32. The discharge from the compressor will pressurize the macaroni tubing 44 which pushes all of the oil 30 therein into the production tubing 40. This stage continues until the fluid pressure in the production tubing 40 increases to the point to where the controller 140, via the pressure sensor 84, senses that the pressure has exceeded a predetermined threshold.

When this threshold is met or exceeded, the controller 140 transitions the system 20 from the compression stage to the production stage by opening the main motor valve 122, as shown in FIG. 9. With the main motor valve 122 open, the production tubing 40 is placed in fluid communication with the sales line and the oil 30 is moved up the production tubing 40 by the increased and continued fluid pressure in the macaroni tubing 44 caused by the discharge from the compressor. The controller 140 can either be programmed to transition from the production stage to the evacuation stage after a predetermined time period has elapsed, or after the pressure in the production tubing 44 drops below a threshold. Alternatively, the controller 140 could be programmed to transition upon the first occurrence of either of those two conditions.

After the triggering event occurs, the controller 140 transitions the system 20 from the production stage to the evacuation stage (FIG. 10) by closing the main motor valve 122 and by operating the B-valve solenoid to send control gas to each of the B-valves 66, 70, 72, 102, and 104. Accordingly, the motor valves 66, 70, and 104 are now opened, with motor valves 72 and 102 closed. Thus, suction is applied to each of the macaroni tubing 44 and the production tubing 40, while discharge is applied to the casing 32. Most of the oil 30 in the casing 32 will be forced past the one-way valve 42 and into the production tubing 40 and macaroni tubing 44. During this stage, pressure in both the production tubing 40 and the macaroni tubing 44 falls to approximately −10 in. Hg. Once the controller 140 senses a pressure of −10 in. Hg in the production tubing 40, or once a predetermined time period has elapsed, the controller 140 transitions from the evacuation stage to the compression stage.

The fluid pressure in the sales line to which the system 20 of the present invention is connected may vary greatly. This pressure may be as low as 20 PSI up to possibly 1,500 PSI. Most intrastate sales lines are less than 900 PSI, however. Nevertheless, because of the inherent pressurized nature of the system 20 of the present invention, it is possible to produce against sales lines with fluid pressures up to roughly 1,000 PSI.

Once the system 20 has been installed in a given well for a sufficient time, it may be possible to keep the oil level in the surrounding hydrocarbon-bearing zone 26 below the perforations 34, so as to create a halo of dry rock around the bore hole of the well. This dry rock has higher permeability and allows more gas to escape and be produced to the well casing 32. Thus, this system can be used as a secondary recovery system for gas.

As can be appreciated, the system 20 of the present invention is operable to continue to produce hydrocarbons from a well in the last stage of the well's lifetime. Thus, it may be possible to produce the last ten to fifteen percent of gas and fluids contained in the hydrocarbon-bearing zone. Another advantage of the system is that nearly all of the equipment utilized in the system 20 is standard and conventional oil field material. Thus, it is likely to be more rugged and stand up to the use and abuse which is inherent in an oil field. In addition, the reliability of the equipment is higher than other, more complex techniques for producing during the last stage of a well's lifetime. Further, if the lift operators (pumpers) are familiar and comfortable with and can rely upon conventional-appearing equipment, they are more likely to be willing to operate same as opposed to custom-built, highly-toleranced equipment.

The control of paraffin buildup reduces or eliminates the need for hot oiling or chemical treatments for paraffin. This can save as much as $300 to $600 per month per well. The expensive repairing or replacing of a bottom hole pump is also eliminated with the present invention. The expense of rig time to repair rod breaks in rod pumps is eliminated. The expense of finding and repair tubing leaks caused by rod wear is eliminated. There is no need for tubing anchors and the expense of repairing them or the risk of running them in older wells. The lack of reciprocating mass requires far less horsepower (per barrel of oil produced or equivalent) than comparable rod-pumped systems. Virtually all down-hole services can be performed by a pump truck thereby eliminating the expense of rig time. The system is much better able to handle contaminants, such as sand and other materials in the well, than other systems.

The system 20 of the present invention will allow wells to be commercially viable at a far lower formation pressure before abandonment. A typical plunger-based system needs a minimum of 225 PSI (SICP) to run in a 5,000 foot well, which translates to nearly 300 PSI at the formation. The system 20 of the present invention can operate the well down to 5 psi casing pressure or less than 50 PSI formation pressure. This 250 PSI pressure differential can mean the recovery of substantial reserves. Also, the relatively small plunger of the system 20 is relatively less expensive to repair or replace. In addition the system can cope with a far wider range of gas to oil ratios. Most importantly, low bottom hole pressures allow maximum recovery of reserves in a minimum of time, thereby enhancing financial performance. Lastly, the system can be installed and wells currently equipped with either 2⅞ or 2⅜ inches conventional production tubing.

The foregoing description is considered as illustrative only of the principles of the invention. Furthermore, since numerous modifications and changes will readily occur to those skilled in the art, it is not desired to limit the invention to the exact construction and process shown as described above. For example, depending upon the particular characteristics of the well, the formation (hydrocarbon-bearing zone), the relative sizes of the tubing, and other factors, the pressures, time periods, and other parameters may vary accordingly. Bearing this in mind, all suitable modifications and equivalents may be resorted to falling within the scope of the invention as defined by the claims which follow.

The invention claimed is:

1. A method of producing hydrocarbons from a well having a wellhead and a well bottom, with an elongated well casing received therein, the well casing having a perforation zone defined therein proximate to the well bottom, utilizing a compressor located at the wellhead, the method comprising:

a. providing first and second elongated chambers within the casing, each chamber extending from the wellhead to an area proximate to the perforation zone of the well casing, the first and second chambers being in constant fluid communication with each other;

b. increasing the fluid pressure in the first chamber, by applying discharge from the compressor thereto, to force fluids from the first chamber into the second chamber;

c. receiving fluids from the second chamber at the wellhead; and d. decreasing the fluid pressure in the first and second chambers, by applying suction from the compressor thereto, to draw fluids from the well casing into the first and second chambers.

2. A method as defined in claim 1, wherein one of the first and second chambers is located within the other of the first and second chambers.

3. A method as defined in claim 2, wherein the first and second chambers are concentrically located.

4. A method as defined in claim 2, wherein the second chamber is located within the first chamber.

5. A method as defined in claim 4, wherein the providing step includes providing a third chamber defined between the outer surface of the first chamber and the well casing, wherein the first chamber is in fluid communication with the third chamber via a one-way valve which opens when the fluid pressure in the third chamber is higher than the fluid pressure in the first chamber and closes when the fluid pressure in the third chamber is lower than the fluid pressure in the first chamber.

6. A method as defined in claim 1, wherein steps b, c, and d are repeated cyclically to produce fluids from the well.

7. A method as defined in claim 1, wherein the third chamber is in fluid communication with the wellhead to receive gaseous fluids therefrom.

8. A method as defined in claim 5, wherein suction from the compressor is selectively applied to the third chamber to increase the flow of hydrocarbons through the perforation zone into the third chamber.

9. A method as defined in claim 8, wherein the method further includes:

a compression cycle including the act described in paragraph b;

a production cycle including the act described in paragraph c; and an evacuation cycle including the act described in paragraph d;

wherein suction from the compressor is applied to the third chamber during the compression and production cycles.

10. An artificial lift apparatus for a hydrocarbon producing well having a wellhead and a well casing therein, the wellhead being connected to a sales pipeline for producing hydrocarbons thereto, the well casing having a perforation zone therein to allow hydrocarbons to enter the well from the surrounding subterranean region, the lift apparatus being connectable to a compressor having a suction port and a discharge port, the lift apparatus comprising:

a first elongated tubing extending from the wellhead to a depth in the well in the vicinity of the perforation zone of the well casing, the tubing having a one-way valve near a bottom end thereof to allow hydrocarbons in the well casing to enter the first tubing when the fluid pressure on the well casing side of the one-way valve is greater than the fluid pressure on the first tubing side of the one-way valve, and the tubing having a control valve near an upper end thereof that is selectively coupleable to the suction and discharge ports of the compressor;

a second elongated tubing extending from the wellhead to a depth in the well in the vicinity of the perforation zone of the well casing, the second tubing being in fluid communication with the first tubing in the vicinity of a bottom end of the second tubing, the second tubing having a control valve near an upper end thereof that is selectively closed or coupleable to the sales pipeline or to the suction port of the compressor;

wherein the lift apparatus is operated in cyclic fashion, with a compression stage in which the first tubing is coupled to the discharge port of the compressor while the control valve of the second tubing is closed, a production stage in which the first tubing is coupled to the discharge port of the compressor while the second tubing is coupled to the sales pipeline, and an evacuation stage in which the first and second tubing are each coupled to the suction port of the compressor.

11. An apparatus as defined in claim 10, wherein the second tubing is located within the first tubing.

12. An apparatus as defined in claim 10, wherein a chamber is defined by and within the well casing, the chamber being in selective fluid communication with the sales pipeline and in constant fluid communication with the surrounding subterranean region through the perforation zone.

13. An apparatus as defined in claim 10, further including a plunger slidably received within the second tubing to decrease the build-up of substances on the inner surface of the second tubing.

14. An apparatus as defined in claim 13, wherein the upper portions of the second tubing are heated by the heat in the upper portion of the first tubing resulting from the inherent heat generated by the compression process of the compressor and delivered to the first tubing through the discharge port of the compressor.

15. An apparatus as defined in claim 10, further including a controller communicating with the control valves of the first and second tubing to control said valves.

16. An apparatus as defined in claim 15, wherein the controller transitions from the compression stage to the production stage after sensing an increase in fluid pressure in the second tubing past a predetermined threshold.

17. An apparatus as defined in claim 15, wherein the controller transitions from the production stage to the evacuation stage after sensing a decrease in fluid pressure in the second tubing past a predetermined threshold.

18. An apparatus as defined in claim 15, wherein the controller transitions from the production stage to the evacuation stage after a predetermined time period elapses from the entry into the production stage.

19. An apparatus as defined in claim 15, wherein the controller transitions from the evacuation stage to the compression stage after sensing a decrease in fluid pressure in either the first or second tubing past a predetermined threshold.

20. An apparatus as defined in claim 15, wherein the controller transitions from the evacuation stage to the compression stage after a predetermined time period has elapsed from the entry into the evacuation stage.

21. An apparatus as defined in claim 13, wherein the second tubing includes a decelerator located therein near the upper end thereof to decelerate the rising plunger, the decelerator including a piston slidably received within the second tubing and constrained for movement in a region near the upper end of the second tubing.

22. An apparatus as defined in claim 13, wherein the second tubing includes a decelerator located therein near the lower end thereof to decelerate the falling plunger, the decelerator including a spring.

23. An apparatus as defined in claim 18, wherein the second tubing includes a plunger catcher to prevent the plunger from falling back down the second tubing until such time as it is desired for the plunger to fall.

24. An apparatus as defined in claim 23, wherein the plunger catcher is pneumatically operated and includes a finger that can be forced to protrude into the second tubing.

25. An apparatus as defined in claim 10, wherein the hydrocarbons are produced at a sufficiently high pressure to supply to a high pressure sales pipeline.

26. An apparatus as defined in claim 10, wherein the second tubing is equal to or less than 1.75 inches in diameter.

27. An artificial lift apparatus for a hydrocarbon producing well having a wellhead and a well casing therein, the wellhead being connected to a sales pipeline for producing hydrocarbons thereto, the well casing having a perforation zone therein to allow hydrocarbons to enter the well from the surrounding subterranean region, the lift apparatus being connectable to a compressor having a suction port and a discharge port, the lift apparatus comprising:

a first elongated tubing extending from the wellhead to a depth in the well in the vicinity of the perforation zone of the well casing, the tubing having a one-way valve near a bottom end thereof to allow hydrocarbons in the well casing to enter the first tubing when the fluid pressure on the well casing side of the one-way valve is greater than the fluid pressure on the first tubing side of the one-way valve, and the tubing having a control valve near an upper end thereof that is selectively closed or coupleable to the sales pipeline or coupleable to the suction port of the compressor;

a second elongated tubing extending from the wellhead to a depth in the well in the vicinity of the perforation zone of the well casing, the second tubing being in fluid communication with the first tubing in the vicinity of a bottom end of the second tubing, the second tubing having a control valve near an upper end thereof that is selectively coupleable to the suction and discharge ports of the compressor;

wherein the lift apparatus is operated in cyclic fashion, with a compression stage in which the second tubing is coupled to the discharge port of the compressor while the control valve of the first tubing is closed, a production stage in which the second tubing is coupled to the discharge port of the compressor while the first tubing is coupled to the sales pipeline, and an evacuation stage in which the first and second tubing are each coupled to the suction port of the compressor.

28. An artificial lift apparatus for a hydrocarbon producing well having a wellhead and a well casing therein, the wellhead being connected to a sales pipeline for producing hydrocarbons thereto, the well casing having a perforation zone therein to allow hydrocarbons to enter the well from the surrounding subterranean region, the lift apparatus being connectable to a compressor having a suction port and a discharge port, the lift apparatus comprising:

a first elongated tubing extending from the wellhead to a depth in the well in the vicinity of the perforation zone of the well casing, the tubing having a one-way valve near a bottom end thereof to allow hydrocarbons in the well casing to enter the first tubing when the fluid pressure on the well casing side of the one-way valve is greater than the fluid pressure on the first tubing side of the one-way valve, and the tubing having a control valve near an upper end thereof that is selectively coupleable to the suction and discharge ports of the compressor;

a second elongated tubing extending from the wellhead to a depth in the well in the vicinity of the perforation zone of the well casing, the second tubing being in fluid communication with the first tubing in the vicinity of a bottom end of the second tubing, the second tubing having a control valve near an upper end thereof that is selectively closed or coupleable to the sales pipeline or to the suction port of the compressor;

wherein the lift apparatus is operated in cyclic fashion, with a compression stage in which the second tubing is coupled to the discharge port of the compressor while the control valve of the first tubing is closed, a production stage in which the second tubing is coupled to the discharge port of the compressor while the first tubing is coupled to the sales pipeline, and an evacuation stage in which the first and second tubing are each coupled to the suction port of the compressor.

29. An artificial lift apparatus for a hydrocarbon producing well having a wellhead and a well casing therein, the wellhead being connected to a sales pipeline for producing hydrocarbons thereto, the well casing having a perforation zone therein to allow hydrocarbons to enter the well from the surrounding subterranean region, the lift apparatus being connectable to a compressor having a suction port and a discharge port, the lift apparatus comprising:

a first elongated tubing extending from the wellhead to a depth in the well in the vicinity of the perforation zone of the well casing, the tubing having a flow restrictor near a bottom end thereof to allow hydrocarbons in the well casing to enter the first tubing when the fluid pressure on the well casing side of the flow restrictor is greater than the fluid pressure on the first tubing side of the flow restrictor, and the tubing having a control valve near an upper end thereof that is selectively coupleable to the suction and discharge ports of the compressor;

a second elongated tubing extending from the wellhead to a depth in the well in the vicinity of the perforation zone of the well casing, the second tubing being in fluid communication with the first tubing in the vicinity of a bottom end of the second tubing, the second tubing having a control valve near an upper end thereof that is selectively closed or coupleable to the sales pipeline or to the suction port of the compressor;

wherein the lift apparatus is operated in cyclic fashion, with a compression stage in which the first tubing is coupled to the discharge port of the compressor while the control valve of the second tubing is closed to increase the pressure in the first and second tubing, a production stage in which the first tubing is coupled to the discharge port of the compressor while the second tubing is coupled to the sales pipeline to allow a majority of the hydrocarbons in the first and second tubing to be displaced along the second tubing to the wellhead, and an evacuation stage in which the first and second tubing are each coupled to the suction port of the compressor to draw hydrocarbons in the well casing and the surrounding subterranean region through the flow restrictor into the first and second tubing.

* * * * *

UNITED STATES PATENT AND TRADEMARK OFFICE

CERTIFICATE OF CORRECTION

PATENT NO. : 5,911,278
APPLICATION NO. : 08/880011
DATED : June 15, 1999
INVENTOR(S) : Donald D. Reitz It is certified that error appears in the above-identified patent and that said Letters Patent is hereby corrected as shown below:

Column 16, line 56;
Change "18" to read -- 13 --.

Signed and Sealed this

Twentieth Day of February, 2007

JON W. DUDAS
*Director of the United States Patent and Trademark Office*